United States Patent [19]

Bowman et al.

[11] 4,319,378

[45] Mar. 16, 1982

[54] CHIMNEY CLEANER

[76] Inventors: Samuel J. Bowman; William F. Bowman, both of 307 Berks St., Pottstown, Pa. 19464

[21] Appl. No.: 166,199

[22] Filed: Jul. 7, 1980

[51] Int. Cl.[3] ..... F23J 3/02

[52] U.S. Cl. ..... 15/162; 15/104.16; 15/242

[58] Field of Search ..... 15/162, 163, 242, 243, 15/104.05, 104.06 R, 104.16, 104.2, 249

[56] References Cited

U.S. PATENT DOCUMENTS

| | | | |
|---|---|---|---|
| 1,293,777 | 2/1919 | Hogue | 15/243 |
| 1,979,143 | 10/1934 | Cullen | 15/163 |
| 2,284,391 | 5/1942 | Hefle | 15/163 |
| 2,579,813 | 12/1951 | Frank | 15/104.05 X |
| 2,604,521 | 7/1952 | Boucher | 15/104.05 X |

*Primary Examiner*—Edward L. Roberts

*Attorney, Agent, or Firm*—Ruth Moyerman

[57] ABSTRACT

A chimney cleaner of universal application and especially suitable for cleaning heavy wood resin residue is disclosed. An A-frame assembly capable of expansion and contraction to accommodate various chimney sizes is held together by pivot connections. The manual reciprocation of the cleaner by a user through a rod which forms the cross bar of the A-frame produces a longitudinal reciprocation of the A-frame. A right angled brush may be removably mounted on the A-frame along its top and fits into a chimney outwardly from a corner. The legs of the A-frame end in wheels which ride up and down the chimney corner opposite the brush. The chimney cleaner's overall dimensions may be increased or decreased by applying a torque to the rod which, through a threaded connection with a leg, will cause the legs to spread or contract.

8 Claims, 8 Drawing Figures

FIG. 2
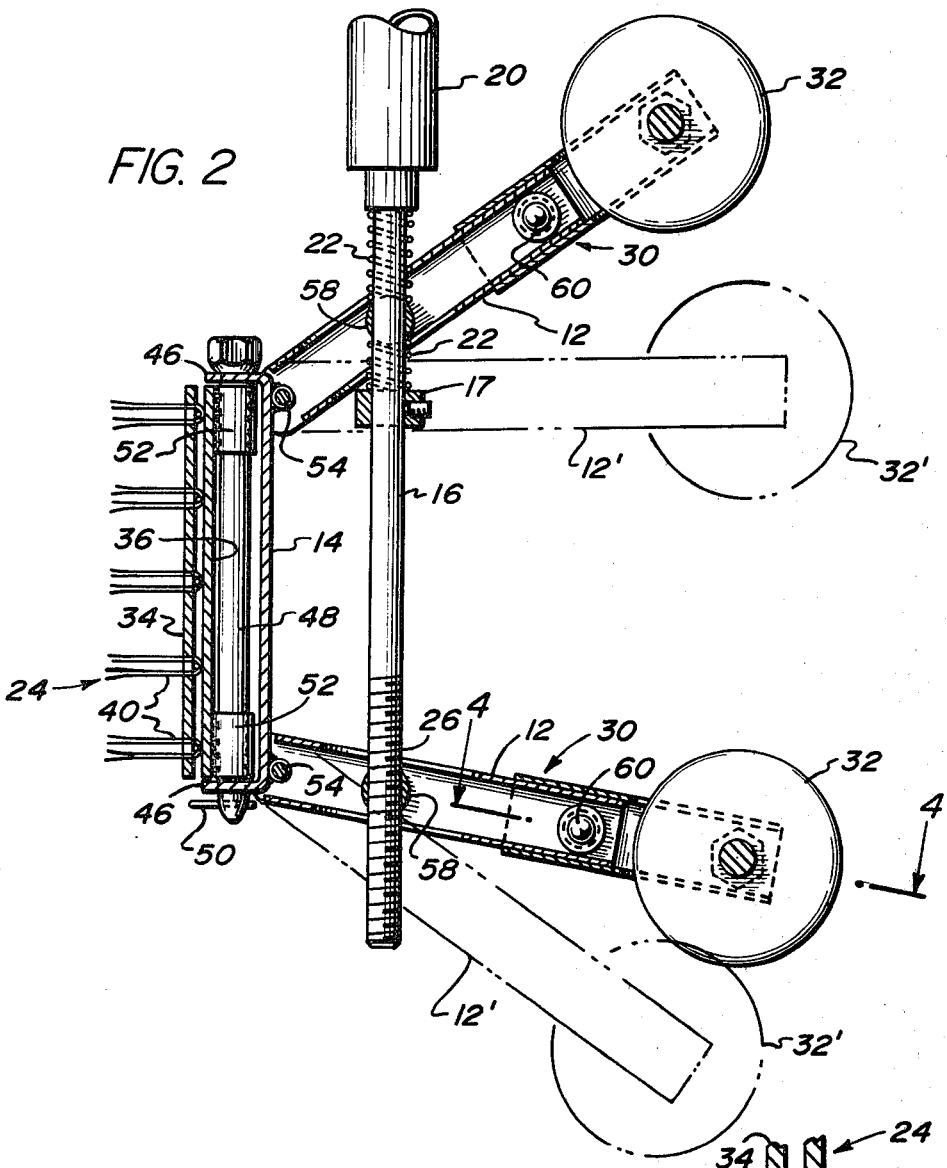
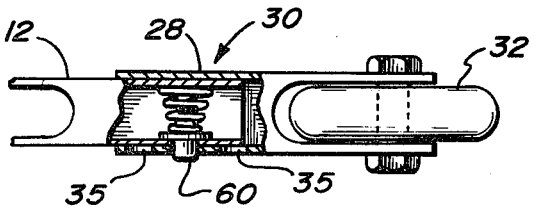
FIG. 4
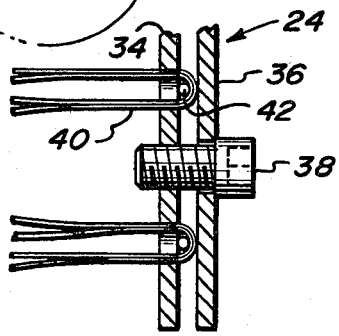
FIG. 3

FIG. 5
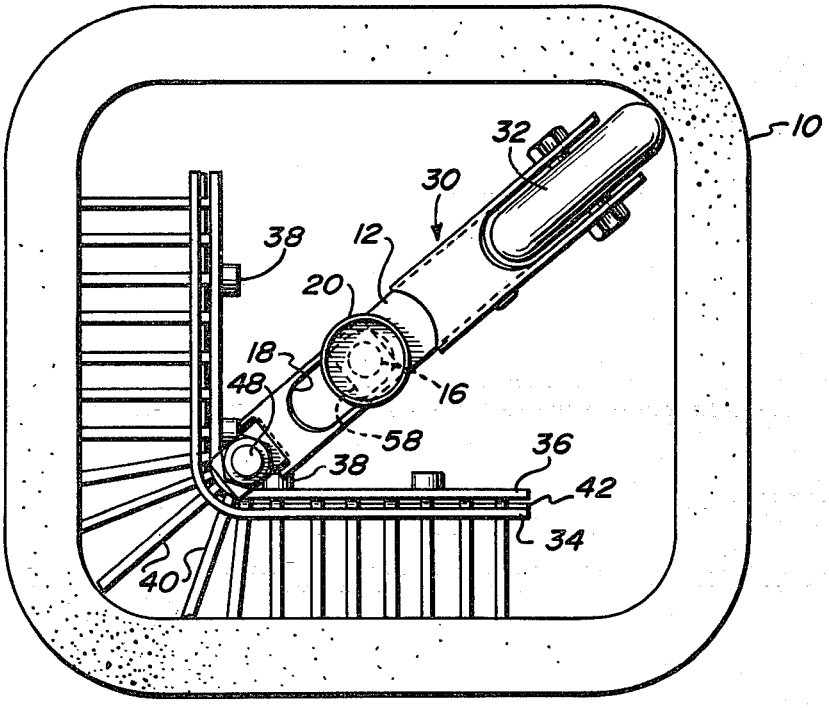
FIG. 6
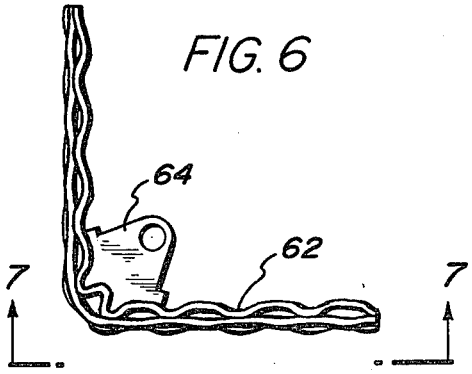
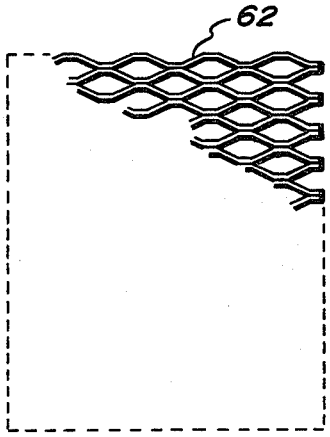
FIG. 7
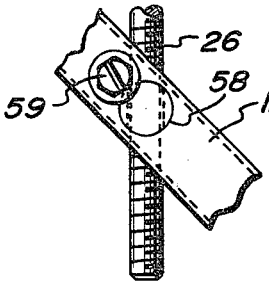
FIG. 8

CHIMNEY CLEANER

BACKGROUND OF THE INVENTION

1. Field of the Invention

This invention relates to brushing, scrubbing and general cleaning and more particularly to flue cleaners.

2. Description of the Prior Art

Many devices are known whose purpose is to serve as a chimney or flue cleaner. In our country's not too distant past, stoves for heating or cooking and fireplaces for general warmth were common in every household. The chimney sweep, as a profession, goes back to 19th century England where boys were employed to use rattan brushes on the end of a rod to clean a chimney of accumulated material.

The prior art collection of U.S. patents has reference as old as U.S. Pat. No. 77,466 which shows a ratchet jack arrangement giving a torque to a set of four chimney brushes for simultaneously cleaning all sides of a chimney. Other prior art references, U.S. Pat. Nos. 1,629,990 and 1,801,718, both to Buchholtz, disclose adjustable chimney cleaners utilizing rods on which a spider is centrally mounted. Flat springs are secured intermediate therein to the cross heads of the spider and are provided with the cleaning brushes. These references are typical of the attempt to solve the problem of chimney cleaning, especially cleaning of the heavy and adherent coating normally associated with the rosins generated by burning wood. Known prior art devices not only are obsolete, but unsatisfactory for this heavy duty work.

Examples of such other out-moded references include U.S. Pat. Nos. 328,967 to Oelschleger, 181,672 to Grimes, 1,500,886 to Nelson, 1,530,557 to Grube et al, 1,979,143 to Cullen and 2,284,391 to Hefle.

Thus, the cleaning of a chimney remains to this day, not only a dirty, inconvenient job, but one in which a need for truly suitable apparatus remains. There is therefore still a need for a chimney cleaner which, while of universal application, is especially intended to clean wood resin residue. The device ideally should be easy to assemble, disassemble and transport. Yet, while incorporating those features, it should nonetheless be easy to use by one of ordinary strength. Finally, the apparatus must be capable of being manufactured at a moderate price.

SUMMARY OF THE INVENTION

The aforementioned prior art problems are solved by the chimney cleaner of this invention. The chimney cleaner of this invention includes a frame on which a brush is removably attached. The frame includes a longitudinal bracket for a brush. At each end of the bracket a leg is pivotally mounted. The legs terminate at their other end in connections for wheels.

A rod which is parallel to the brush holding bracket passes through and also connects the legs, giving the overall assembly the shape of an A-frame. Pivotal journal bearings within the legs allow the leg-to-rod connection some freedom of movement and the pivot fastener of the leg-to-bracket connection also allows free play. This free play is essential to the chimney cleaning in that it allows the user to gain a better scrubbing or brushing action by virtue of a lead-lag effect. That is, a longitudinal reciprocation movement of the rod produces a parallel longitudinal reciprocation of the A-frame and the brush attached to it.

One end of the rod has a connection to allow rod extensions and an extensible handle, or handle sections, to be attached to the rod to enable the chimney cleaner to be lowered the full necessary length within the chimney.

Adjustable means to enable the chimney brush to be tightly maintained against the inside chimney wall includes a threaded rod portion and a mating thread inside of the journal bearings in one of the leg-to-rod connections. Thus, applying a torque to the rod will cause the A-frame leg sections to expand or contract making the overall chimney cleaner wider or narrower as needed.

Other important features of the invention include a right-angled brush section removably mounted on the brush retaining bracket by bolt and cotter pin. A preferred brush consists of two right-angled plates bolted together in stacked relationship. One plate is reticulated and replaceable, looped bristles may be inserted through the holes. The bristles are held by pins through the bristle bend aligned between the plates.

A second brush employs a pair of wire mesh triangles joined at right angles and works as a rasp.

The frame assembly may also include, additionally, removable telescoping wheels. The wheels may be an interlocking sleeve connection with the legs, and the locking means is preferably by spring loaded detents in the frame legs which mate with corresponding aperatures on the wheels.

To add greater versatility in adapting the chimney cleaner to unusual or especially tight fits, helical springs may be mounted in a tensioned position on one or both sides of the non-threaded journal bearing leg-to-rod connection. These springs aid the lead-lag motion of the cleaner.

It is therefore an object of this invention to provide a chimney cleaner which is especially adapted to clean the heavy and very adhesive tar buildup which occurs in flues in which wood is burned.

It is yet another object of this invention to provide a chimney cleaner which may be adaptable to coventional flue brushes and which is adjustable to varying chimney sizes.

It is still another object of this invention to provide a chimney cleaning apparatus which is strong enough to perform heavy duty cleaning but which is constructed in such a way that it may still be manually operated by one of ordinary strength.

It is yet another object of this invention to provide an assembly which is easily adjustable to varying chimney sizes but which is still small enough to readily allow its transportation from ground to rooftop with minimum inconvenience.

It is still another object of this invention to provide the aforementioned apparatus with parts that are interchangeable so that the device may be sold at a price within the financial reach of homeowners.

These and other objects may be more readily ascertainable to one skilled in the art from a consideration of the Figures and following description and exemplary embodiments.

BRIEF DESCRIPTION OF THE DRAWINGS

FIG. 2 shows a cross section taken on lines 2—2 of FIG. 1 with the addition of a phantom section of the legs and rod shown to illustrate the degree of movement of the chimney cleaner during its operation.

FIG. 3 shows a cross section taken on lines 3—3 of FIG. 1.

FIG. 4 shows a cross section taken on lines 4—4 of FIG. 2.

FIG. 5 shows a top plan view of the cleaner in a chimney.

FIG. 6 shows an alternate cleaning implement.

FIG. 7 shows a cross section taken on lines 7—7 of FIG. 6.

FIG. 8 shows an enlargement of the threaded journal bearing.

DESCRIPTION OF THE PREFERRED EMBODIMENT(S)

Figure 1:
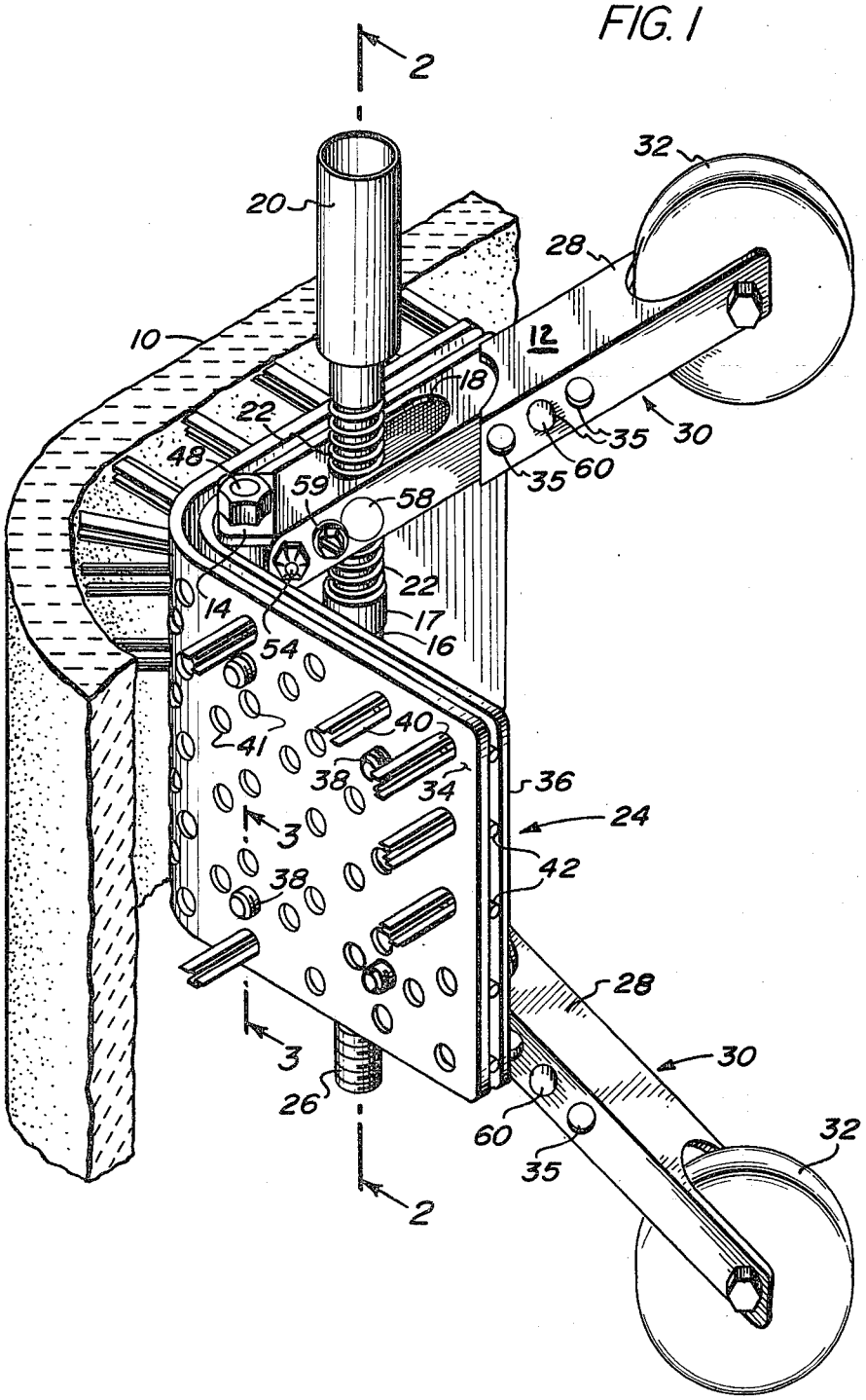
FIG. 1 shows an isometric of the preferred embodiment of the chimney cleaner of this invention.

Referring now to the drawings and more particularly to FIG. 1, an isometric of the chimney cleaner of this invention is shown generally mounted in chimney 10 shown in cutaway view. The chimney cleaner includes legs 12, shown in spaced apart relationship. Barely visible in FIG. 1 is brush retaining bracket 14 to which one end of each of legs 12 is pivotally connected. Rod 16 is shown passing through legs 12 at slot 18. The intersection of legs 12 with rod 16 is by a pivotal journal bearing 58 and locking screw 59 which will be shown in detail in FIG. . Rod 16 terminates in connector 20 to which the rod extensions and/or handle means (not shown) may be attached. The particular view shown in FIG. 1 shows to great advantage helical springs 22 shown surrounding rod 16 at its intersection with legs 12. Helical springs 22 are tensioned and held in the tensioned position by locking sleeve 17 on the rod. As will be subsequently explained in reference to FIG. 2, the chimney cleaner, through an up and down motion of the rod, causes a reciprocating up and down thrust of legs 12 and brush 24 attached thereto through bracket 14. The purpose of helical springs 22 is to aid this motion in an especially tight or off-centered chimney. Rod 16 terminates in a threaded segment 26 which will be explained in detail in reference to FIG. 8.

Legs 12 terminate in a sleeve fitting which is adapted to mate with sleeve fitting 28 of wheel assembly 30. Wheel assembly 30 terminates in wheels 32 which are designed to ride up and down inside of chimney 10 as may be seen and will be described in connection with FIG. 5. Wheel assembly 30 includes apertures 35 designed to mate with detents within leg 12 and which are shown in detail in reference to FIG. 4.

Also visible in FIG. 1 is brush assembly 24. Brush assembly 24 includes outer reticulated plate 34 and inner plate 36 held together in stacked relationship by bolts 38. Bristles 40 comprising U-shaped bends to metal are positioned between plates 34 and 36 through apertures 41 and are held in position by laterally extending pins 42.

Referring now to FIG. 2, which is a cross section taken on lines 2—2 of FIG. 1, more detail of the apparatus and how it operates is shown. The mounting of brush assembly 24 is shown in more detail. Bracket 14 which includes a longitudinal section terminates at each end in flanged portions 46. The flanged portions are aperatures and bolt 48 is slidably mounted through the apertures. Cotter pin 50 holds bolt 48 in place. Brush assembly 24 has two sleeve sections 52 which are likewise apertured and through which bolt 48 also passes. Thus, brush assembly 24 is removably held and other brush attachments may readily be substituted to accommodate different cleaning operations.

In FIG. 2, pin connections 54 are more visible. It should be noted that a connection at this point between legs 12 and brush retaining bracket 14 must allow legs 12 and wheels 32 to pivot so that the whole A-frame assembly comprising legs, wheels, bracket and rod 16 may be reciprocated which movement is illustrated in phantom in FIG. 2 by legs 12' and wheels 32'. This reciprocating motion is also aided by pivoting journal bearings 58 which form the leg-to-rod connection.

Another important feature of this invention relates to the adjustment which enables the chimney cleaner to be adjusted for various chimney sizes. While the telescoping wheels are suitable for gross adjustment, a fine adjustment is easily made within the cleaner itself, as shown in both FIGS. 2 and 8.

By manually rotating rod 16, the torque applied will operate through threads 26. The corresponding journal bearing is likewise threaded and, thus, the turning of rod 16 will operate to either increase or decrease the spread between legs 12. This increase or decrease changes the overall dimension of the cleaner to accommodate various chimney sizes.

Referring now to FIG. 4 which is a section taken on lines 4—4 of FIG. 2, more detail is shown of the connection of wheel assembly 30 to legs 12. It may be seen in FIG. 4 that legs 12 preferably end in a sleeve fitting intended to slip into a mating sleeve connection 28 of wheel assembly 30. Sleeve 28 includes aperture, or apertures, 35 and leg 12 includes spring loaded detent 60 which pops into aperture 35 thus securing the wheel assembly on the leg.

Referring now to FIG. 3, an enlarged detail of brush assembly 24 is shown. Bristles 40 which pass through outer plate 34 are more clearly shown. Bristles 40 rest against plate 36 and pins 42 hold them in place. Bolts 38 secure the entire brush assembly.

Referring now to FIG. 5, a top plan view of the chimney cleaner of this invention is shown in a chimney 10 to illustrate the relative position of the chimney cleaner, particularly the axis of the brush and the wheels. It should be noted that the right angle bend of brush assembly 30 permits the brush to fit securely in a corner of the chimney radiating outwardly along the chimney's sides. Diagonally opposing the brush, the cleaner ends in wheels 32 which ride along the opposing corner of the chimney. Slot 18 in leg 12 is more clearly visible in this view, together with journal bearing 58 through which rod 16 is passing. The up and down motion of rod 16 will cause a lead-lag drag of the brush cleaner through the A-frame pivot points giving an increased brushing efficiency of chimney 10.

Referring now to FIGS. 6 and 7, an alternate embodiment for a brush is shown. In FIGS. 6 and 7 a triangular wire mesh with a right angle bend is utilized. Wire mesh 62 operates as a rasp in those applications where this abrasive action is needed. The rasp also includes a bracket mounting 64 to enable the rasp to be mounted by bolt 48 through flanges 46 of the chimney cleaner.

Referring now to FIG. 8, a detail of the threaded journal bearing is shown including rod threads 26 passing through the journal bearing 58 of leg 12. Locking screw 59 is also shown.

The chimney cleaner of this invention offers many advantages over prior art devices for the same purpose. A particular advantage is realized over the conventional cleaner in which bristles are located around a central twisted stem or shaft. In this former case, to have bristles stiff enough to clean a chimney means that it is a near physical impossibility to manually work the brush upward and downward in the chimney. The device of this invention, by contrast with its lead-lag drag created by the pivoting A-frame, means that the user can tightly fit the brush within the chimney and still be able to manipulate it with only ordinary manual strength.

Another advantage relates to the elimination of the dangling and rotating chains now associated with conventional flue brushes, expecially those available to the do-it-yourself. Brushes are easily removed and replaced lending versatility to the cleaner. The slight bends commonly associated with various chimney flues do not present a problem with the chimney cleaner of this invention because of its basic construction and because of the auxiliary springs on the rod.

The adjustable feature associated with the wheels and the replaceability of the wheels themselves by wheels with longer connecting sections is even more advantageous.

Having now illustrated the invention it is not meant for such description to limit the invention, but rather than the invention be limited only by reasonable interpretation of the apended claims.

What is claimed is:

1. A chimney cleaner intended to receive a brush removably attached thereto comprising:

(a) a pair of legs spaced and pivotally held apart at their one end by an elongated brush retaining bracket and at their other end each adapted to receive a wheel;

(b) a rod parallel to said bracket passing through each of said legs;

(c) pivotal journal bearings within each of said rod-to-leg intersections to receive said rod, said rod, two legs and bracket forming an A-frame, said bracket-to-leg and rod-to-leg pivot points thereby allowing a parallel longitudinal reciprocation of the brush retaining bracket to be produced when a longitudinal reciprocation by a manual upward and downward thrust is applied to said rod within a chimney; and, (d) threads located on said rod segment which passes through one of said journal bearings and also mating threads within said corresponding leg's journal bearing whereby a torque applied to said rod changes the width between said legs and therefore said chimney cleaner's overall diameter so that a brush mounted on said brush retaining bracket may be tensioned against the chimney wall to be cleaned.

2. The chimney cleaner according to claim 1 wherein said rod is adapted at one of its ends to receive extensible handle means.

3. The chimney cleaner according to claim 1 comprising, additionally:

(e) helical springs tensioned on the rod on both sides of the non-threaded journal bearing rod-to-leg connection.

4. The chimney cleaner according to claim 1 wherein said brush retaining bracket comprises a longitudinal section terminating at each end in a flanged portion, each flange portion being apertured to receive and pivotally retain a bolt.

5. The chimney cleaner according to claim 1 wherein said wheels are each rotatably mounted on the end of a locking sleeve and each of said sleeves is adapted to telescopically mate with one of said legs.

6. The chimney cleaner according to claim 5 comprising locking sleeve connections which include a spring loaded detent in each said leg and at least one aperture in each said mating sleeve to receive said detent.

7. The chimney cleaner according to claim 1 wherein said chimney cleaner includes a brush, said brush comprising:

(a) a pair of generally right-angled parallel plates removably connected to each other in stacked relationship and removably connected to said brush retaining bracket, said outer plate being reticulated to receive bristles;

(b) bristles each comprising at least one U-shaped member adapted to pass through the reticulated plate; and, (c) a plurality of pin members lying laterally between said plates, said pin members engaging said bristles at their bend to hold said bristles in place between said plates.

8. The chimney cleaner according to claim 1 wherein said chimney cleaner includes a rasp attachment, said rasp comprising a generally isosceles triangular shaped wire mesh portion with a generally right angle bend along its mid section and bracket means attached to said mid section along said triangular interior axis and adapted to be mounted on said brush retaining bracket.

* * * * *